United States Patent [19]

Palmquist

[11] Patent Number: 4,635,577

[45] Date of Patent: Jan. 13, 1987

[54] HYDROPLANING WING SAILING CRAFT

[76] Inventor: Martti J. Palmquist, 1941 Hastings St., Marietta, Ga. 30062

[21] Appl. No.: 585,101

[22] Filed: Mar. 1, 1984

Related U.S. Application Data

[63] Continuation-in-part of Ser. No. 341,831, Jan. 22, 1982, abandoned.

[51] Int. Cl.[4] ..... B63B 1/24

[52] U.S. Cl. ..... 114/39; 114/163; 114/274; 440/13

[58] Field of Search ..... 114/39, 162, 163, 165, 114/274, 280, 281, 282, 283; 440/13–15, 22

[56] References Cited

U.S. PATENT DOCUMENTS

| | | | |
|---|---|---|---|
| 360,488 | 4/1887 | Sweeney | 114/163 |
| 1,356,300 | 10/1920 | McIntyre | 114/274 |
| 3,456,609 | 7/1969 | Nott | 114/282 |
| 3,547,063 | 12/1970 | Follett | 114/274 |
| 4,218,986 | 8/1980 | Hackney | 114/165 |

FOREIGN PATENT DOCUMENTS

| | | | |
|---|---|---|---|
| 1570966 | 6/1969 | France | 114/274 |

*Primary Examiner*—Sherman D. Basinger
*Attorney, Agent, or Firm*—James A. Hinkle

[57] ABSTRACT

A hydroplaning wing sailing craft comprising a single buoyant hull having mounted transversely across the hull a hydroplaning wing having forward sweep and inverted gull wing shape. The wing having a positive angle of incidence providing hydroplaning lift and buoyancy to counteract the heeling moment and thrust of the sail. Mounted atop the hull and the wing is a high aspect ratio sailing rig. Mounted to the stern of the hull is a biaxial control system permitting simultaneous control of the direction in which the craft moves as well as the pitch attitude of the hull and thereby the angle of attack of the hydroplaning wing.

10 Claims, 5 Drawing Figures

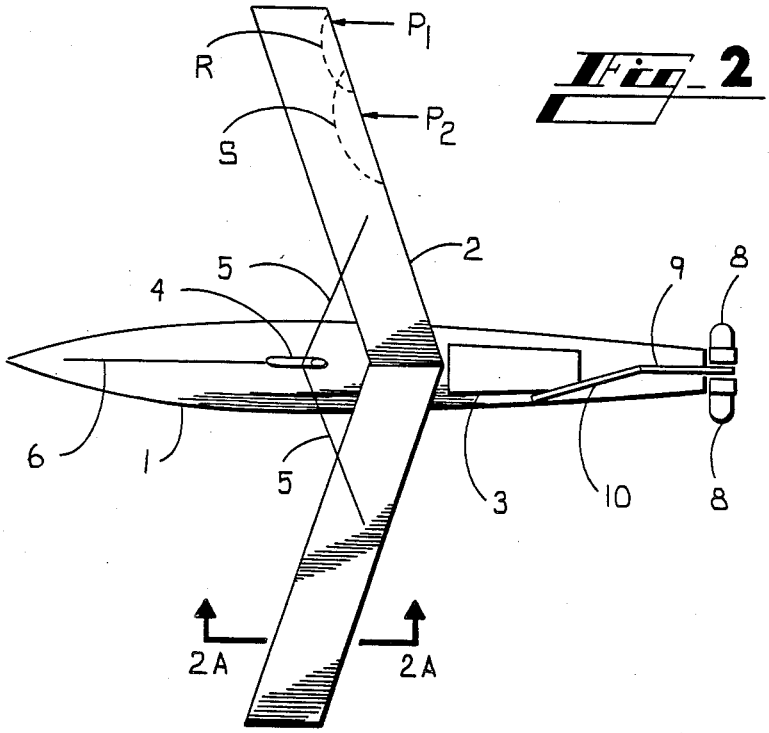
Fig. 2
Fig. 2A
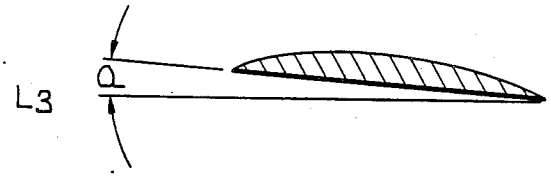

5
5
4
2
P2
P1
W
W
L
L2
L1
1
8
8

HYDROPLANING WING SAILING CRAFT

BACKGROUND OF THE INVENTION

This application is a Continuation-in-Part of Application 341,831, filed Jan. 22, 1982, by the same inventor, Martti J. Palmquist and now abandoned.

The invention pertains to the field of high speed sailboats and more particularly to the field of sailboats using hydroplaning surfaces with special emphasis given to reducing both aerodynamic and hydrodynamic drag.

In recent years there has been much development toward higher speed sailing craft. Most of the fastest boats today use multiple hulls or one or more hulls assisted by hydrofoils. Many of these arrangements are mechanically complicated, heavy, aerodynamically dirty and aesthetically wanting. Although the use of hydrofoils has increased the lift/drag ratio of these craft, most submerged and partially submerged hydrofoil applications have limitations wherein they produce surface draft on both sides of the foil. Further, the rising of the partially submerged foil, when speed increases, reduces the aspect ratio of the wetted foil thereby reducing the hydrodynamic efficiency.

It would therefore be highly desirable to have a mechanically uncomplicated, hydrodynamically and aerodynamically efficient and aesthetically pleasing lightweight sailing craft that is easily controllable at all points of sail and, most of all, to have means of limiting drag build-up to permit an unprecedented speed when under sail.

SUMMARY OF THE INVENTION

It is the principal object of the invention to provide a new and improved sailing craft that can operate with significant speed and control simplicity over that known in present day sailing craft through the use of a hydroplaning wing and an improved biaxial control system.

The preferred embodiment of the invention achieves these objects by means of a construction which includes the single buoyant hull having a narrow beam and a deep V cross section having removably mounted hydroplaning wing located transversely to the longitudinal axis of the hull. The hydroplaning wing is so designed to have a forward sweep with an inverted "gull win shape" and so configured that the lowest part of the wing, when in operative position, is just above the load water line when the craft is leveled about its longitudinal axis.

While it is anticipated that a hull shape with a narrow beam and a deep V cross section will be more hydrodynamically and aerodynamically efficient, it should be noted that virtually any hull shape could be utilized with this invention and the discussion herein concerning a particular type of hull and its shape is not limiting to the invention and should not be considered so limiting. Normally, a narrow beam deep V cross section type of hull operates better from a drag standpoint and such will be the preferred embodiment as discussed herein. In addition, this preferred embodiment will contemplate the use of some type of center board to be the effective means for reducing lateral movement of the craft in the water. However, once again, it is not absolutely necessary that a center board be used, but like most sailing craft, the center board will be part of the sailing craft.

Mounted atop the hull and the hydroplaning wing is a high aspect ratio sailing rig comprising a mast and a fully battened sail which is optimized to give maximum performance at high apparent wind velocities. Once again, it should be noted that any normal sailing rig will work with this invention, but for the best efficiency a sailing rig should have a high aspect ratio.

To provide directional control the stern of the hull of the present invention mounts a unique and simplified biaxial control system giving the helmsman a one-handed positive control means of both the direction in which the craft moves as well as the pitch attitude of the hull. This thereby controls the angle of attack of the hydroplaning wing.

The aforementioned simplified biaxial control system comprises a tiller, a control mixer linkage and two individually hinged rudders mounted in a generally inverted V configuration with each rudder having means by which it may be lowered or raised to any position between fully raised and fully lowered positions while under sail or while sailing in shallow waters. The tiller is hinged so as to permit the helmsman to move it laterally and vertically for adjusting the trim of the rudder. The vertical movement of the tiller is normally tensioned to the neutral position, but it also has means for tensioning it to produce a steady pitch trim moment in either ptich up or pitch down direction as desired by the helmsman.

Further, when the tiller is tensioned in the neutral pitch trim position, this causes the rudders to perform an effective sculling action which produces some forward thrust whenever the craft rocks about its lateral axis. For instance, if the sailing craft is becalmed on a busy inland lake with motorized boats producing a continuous chop, this will automatically produce a sculling action whenever the hull of the sailing craft rocks about its lateral axis. Such sculling action by the rudders produces a partial dampening of the rocking motion thereby leaving the sail less disturbed so as to capture what little wind there may be.

Other objects and advantages will become apparent from the detailed description of the preferred embodiment and of the accompanying drawings.

BRIEF DESCRIPTION OF THE DRAWINGS

FIG. 2 is a top view of the craft with a portion of the sail rig being omitted for clarity;

FIG. 2A shows an enlarged sectional view of the hydroplaning wing and its angle of incidence at section 2A—2A;

DETAILED DESCRIPTION OF THE PREFERRED EMBODIMENT

Figure 1:
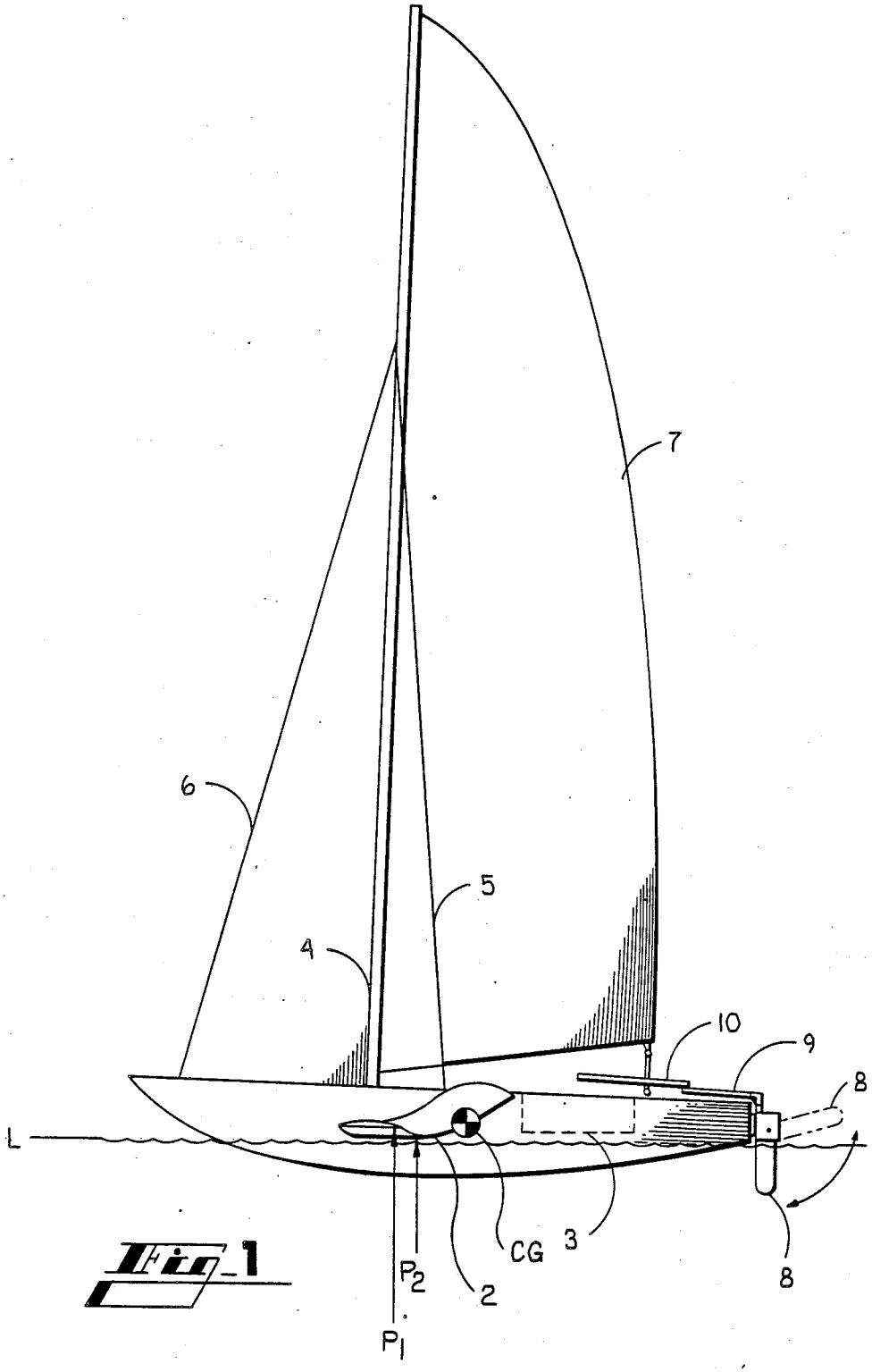
FIG. 1 is a side view of the preferred embodiment of the present invention.
Figure 3:
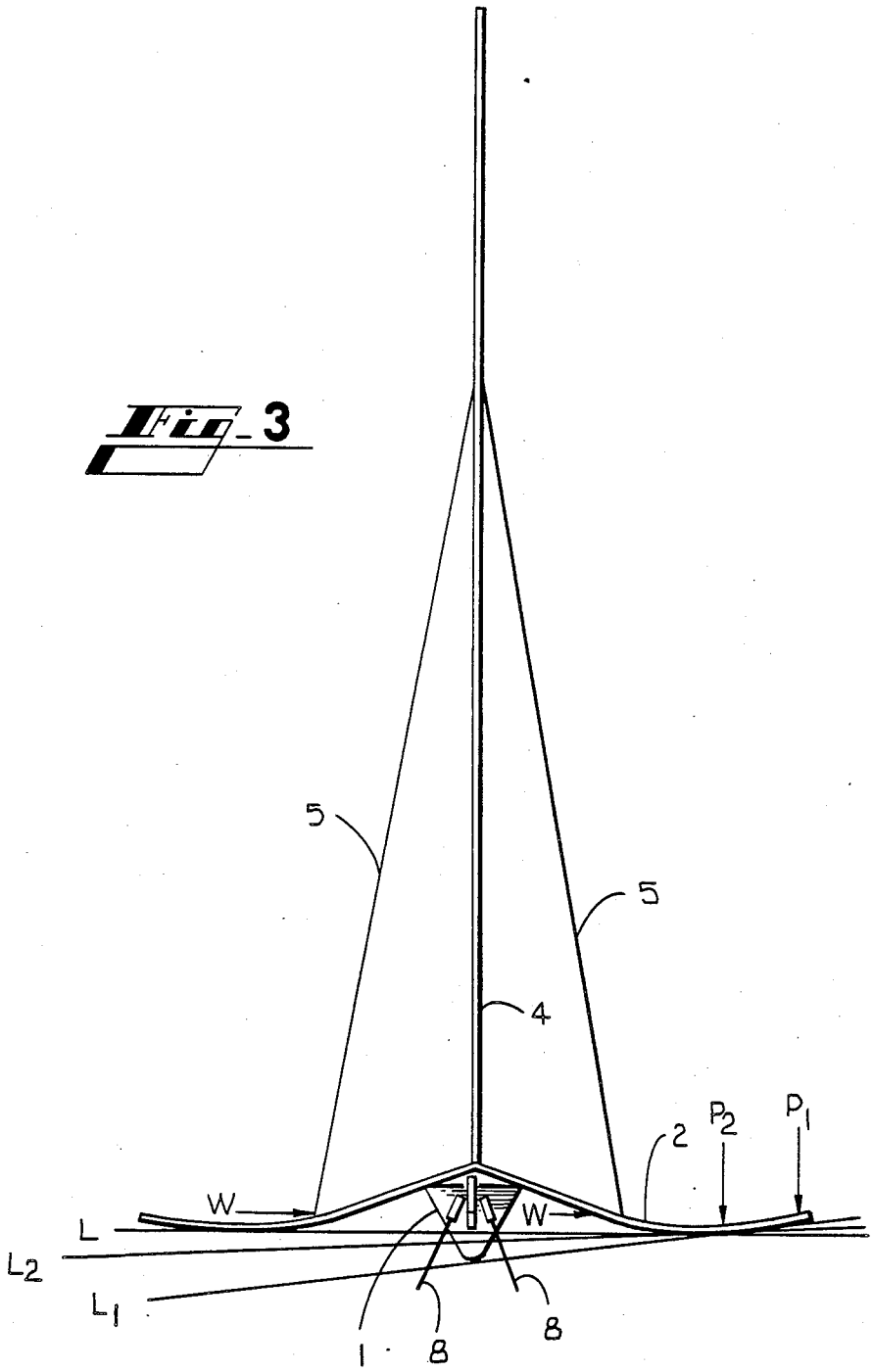
FIG. 3 is a rear view of the craft with the sails being omitted for clarity.

The preferred embodiment of the proposed hydroplaning wing sailing craft according to the present invention is depicted specifically in FIGS. 1, 2 and 3. The invention contemplates the use of a single hull 1 having a narrow beam and a deep V cross-section. As stated earlier in the summary of the invention, it is not necessary that the beam of the craft be narrow nor that the hull shape be of a deep V configuration, but that the invention can utilize virtually any type of hull construction. However, from the standpoint of efficiency, it has been found that a narrow beam deep V shape hull is much more efficient in operation. The hydroplaning wing 2 of the invention is shown particularly in FIG. 2 and is mounted transversely across the hull 1, and in this figure the wing is shown as having a forward sweep. In FIG. 3, the wing 2 is further defined as having an inverted gull wing shape which means that it has a negative angle of dihedral from a central point laterally outward and then gently curves to a slight positive dihedral at each tip where the bottom curvature of each tip is tangent to line L1 drawn from the lowest point of the hull 1 to the point of tangency indicated by P1.

The cockpit of the sailing craft is shown by dashed lines in FIG. 1 and the cockpit is indicated by the numeral 3. Mounted atop the hull 1 is a mast 4 with side stays 5 attached to the wing 2 and with a forward stay 6 attached to the forward part of the hull. FIG. 1 shows the general shape of the high aspect ratio, fully battened sail 7 attached to the trailing edge of the mast 4. While any sailing rig will operate with the present invention, it is anticipated, and it has been found, that a high aspect ratio sailing rig will give best efficiency, and therefore, the invention will be couched in those terms throughout. There is mounted to the stern of the hull a biaxial control system comprising twin rudders 8 mounted in an inverted V configuration wherein in FIG. 1 the rudders are further shown in a downward operative position and by dashed lines in a fully raised position for easy beaching and trailering. Tiller 9 is attached to the biaxial control system through a control mixer linkage and has associated therewith a forward extension 10 which has a certain freedom of movement to allow the helmsman to operate the tiller from the cockpit of the craft.

Turning now to the hydroplaning wing 2 of the invention, it can be seen from FIG. 1 that the craft is shown at rest and that the center of buoyancy of the hull 1 is at or near the center of gravity, indicated by the letters CG. When at rest, the hydroplaning wing 2 provides enough buoyancy to limit heeling to either side with only one side of the hydroplaning wing at a time touching the surface of the waterline, indicated by a line L, in calm sea conditions. As can be seen from FIG. 1, the lowest part of the hydroplaning wing 2 on each side of the craft is above the water-load line of the craft when the craft is leveled abouts is longitudinal axis. FIG. 1 represents the craft at rest in calm sea conditions with Line L indicating the water surface.

In FIG. 2A, there is shown an enlarged sectional view of the hydroplaning wing 2 taken through Lines 2A. It can be seen that the hydroplaning wing has a hydrodynamically clean cross-section and a built-in positive angle (a) of incidence in reference to the longitudinal axis L3 of the craft, so that the wing 2 provides hydroplaning lift on the leeward side of the wind to counteract the heeling moment of the sail 7 when reaching or tacking.

During the initial acceleration of the craft underway, the buoyancy and hydroplaning lift of the hydroplaning wing 2 act together to counteract the heeling moment of the sail 7. When the craft reaches a higher forward speed and the sail 7 is trimmed to produce a greater heeling moment and more forward thrust, the heeling moment of sail 7 and the hydroplaning lift of hydroplaning wing 2, acting in conjunction through point P2 on line L2 (see FIG. 3), combine to partially raise the hull 1 so that the hull drag is reduced while the hull still has enough lateral resistance due to its deep V construction to prevent side movement through the water. Looking at FIG. 1, it can be seen that point P2 is forward of the center of gravity, CG, and thereby the lift produced by the hydroplaning wing 2, acting through point P2 resists the increased forward pitching moment of the increased thrust of sail 7.

If the wind force which is acting on the sail 7 increases to further raise the hull, the center of hydroplaning lift of the hydroplaning wing 2 moves laterally outward and longitudinally forward toward P1, as shown in FIGS. 1, 2 and 3. This is due to the curvature (the inverted gull wing configuration) of the hydroplaning wing 2 and the forward sweep of the wing, thereby compensating for the increased heeling moment and the increased forward pitching moment of the sail 7. This will then tend to stabilize the craft without any action required by the helmsman when the craft begins to pitch forward.

At the above condition described in the preceding paragraph, the hydroplaning wing 2, having more than enough strength and lift to bear the entire weight of the craft, if needed, and enough flexibility to step over most waves, and enough torsional rigidity to prevent tucking of the wing into the water, the forward motion of the hydroplaning wing along the surface of the water will cause a spray to form in front of the advancing wing. As the spray hits the undisturbed surface of the water in front of and underneath the advancing wing, a foaming action takes place and continuously traps air between the bottom of the hydroplaning wing and the surface of the water, thereby causing a significant reduction in drag. This reduction in drag permits an unprecedented increase in boat speed over that previously known for sailing craft.

Figure 4:
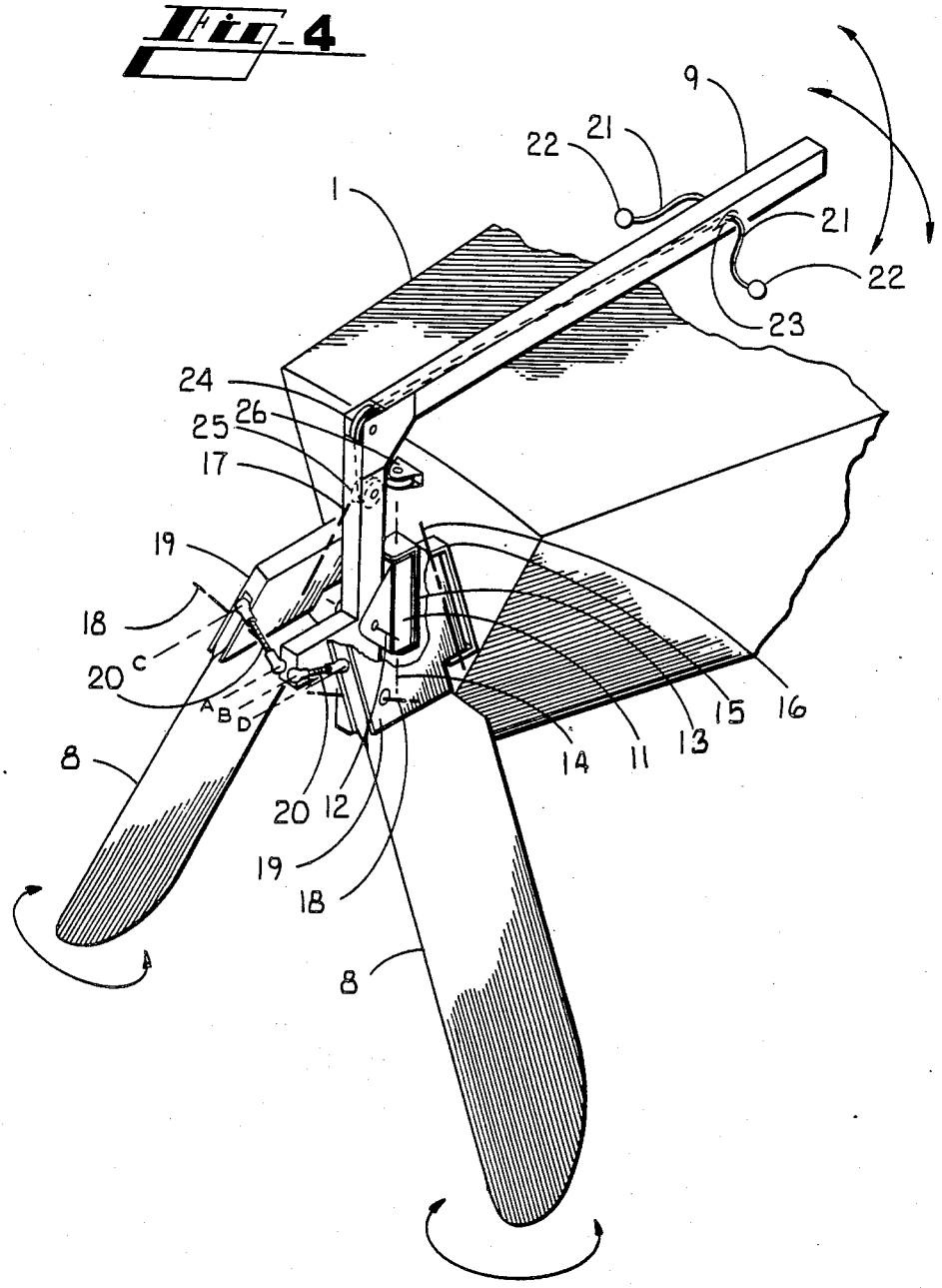
FIG. 4 is a perspective view of the stern and the control system of the present invention with parts of the right rudder removed for clarity.

Referring specifically to FIG. 4, it is seen that at the rear-most part of the Tiller 9, there is attached to its aft-most facing end near the stern of the hull a pair of control mixer linkage rods 20 connected at points A and B. The mixer linkage rods 20 each have universally pivoting attachment points at each end, with the outer ends thereof being attached to the aft-facing part of each of the rudder guide boxes 19 at respective points C and D.

Therefore, if the helmsman moves the tiller 9 downwardly, the tiller then pivots about Axis 12 and the control mixer rod attachment points A and B move upwardly with respect to the hull. In a normal neutral position of the tiller, points A, B, C and D are in approximately the same vertical plane. However, since points A and B are below an imaginary horizontal line connecting points C and D, this causes points C and D to move outward from each other as points A and B move upwardly due to the action of the tiller 9. This in turn results in the rudders 8 toeing inwardly and the dynamic pressure of the rearward water flow passing across the rudders acts laterally inwardly toward the vertical center line of the craft and vertically downward upon the rudders 8. The rigidity of the rudder construction resists the inward force on each rudder 8, and the downward force pitches the bow upward and the stern downward until the center of buoyancy has shifted aft of the center of gravity to counterbalance the downward force exerted on the rudders, or until the pitch attitude of the craft has increased enough to reduce the angle of attack of the toed-in rudders. Conversely, if the helmsman moves the tiller 9 upwardly, a forward-pitching bow downward movement is produced upon the craft.

When the helmsman moves the tiller 9 laterally toward the port, or left side, of the craft, the points A, B, C and D move approximately in unison to the starboard, or right side of the craft, with the distance between points C and D virtually unchanged, causing the rudders 8 to pivot approximately in unison to the left. The dynamic pressure of the rearward water flow upon the rudders 8 acts upon the right rudder laterally inward and vertically downward, while in turn it acts upon the left rudder laterally outward and vertically upward. The up and down forces cancel each other out, and the left-ward forces combine to turn the craft to the right. It can be seen that the lateral control movements of the tiller 9 produce a normal rudder steering effect, and can be combined with vertical control movements to give the helmsman simultaneous one-handed control of the pitch attitude and of the direction in which the craft moves.

As previously mentioned, there are means provided for tensioning the tiller 9 to a normally neutral position of vertical movement and thereby the rudders 8 to the neutral toe-in, toe-out position. The tensioning apparatus consists of two elastic cords 21 with handles 22. The elastic cords 21 pass through walking slots 23 to the inside of the tiller 9, and then extend toward the aft of the craft with each of them passing over pulleys 24. The right side elastic cord 21 continues downward and over an internal pulley 25 and then exits the inside of tiller 9 to pass over a pulley in pulley bracket 26 and then continues aftward thence terminating to the tiller 9. The pulley bracket 26 is attached to the vertical surface of the stern of hull 1. Similarly, the left side elastic cord 21 continues past pulley 24 and downward to an internal pulley (which is shown in FIG. 4 by broken lines) at the lower end of tiller 9, and then exits forward to pass around a pulley (not shown) similar and similarly attached as in pulley bracket 26 and continues aftward with its end terminating to the tiller. By tightening the tension of the right side elastic cord more than the left, the helmsman causes tiller 9 to be tensioned downward, producing a continuous pitch trim moment in the pitch-up direction. The forces produced by the tensioning device are of such magnitude that the helmsman can easily overcome them with little effort.

Also, the tensioning apparatus is partially overcome but resists the alternate dynamic forces of water upon the rudders 8 whenever the craft is in rocking motion about its lateral axis. If the stern of the craft rocks downward, the dynamic pressure of the water moving upward exerts a force on the rudders 8 laterally outward and vertically upward. Since the pivotal axes 16 and 17 of the rudders 8 nearly parallel the leading edges of the rudders, the laterally outward force causes the rudders 8 to toe in. During the toe-in movement, such movement is then resisted by the tensioning apparatus, thereby allowing the rudders 8 to exert a vertical force downward upon the water, and a lateral force inward and because of the toe-in of the rudders 8, the lateral force is vectored partially rearward, producing forward thrust to the craft. If the hull is pitching fore and aft, and the stern rises, the rudders toe out and again produce forward thrust simultaneously, tending to dampen the rocking motion.

Turning to FIG. 4, wherein the biaxial control system is shown in a perspective view, the tiller 9 is pivotally attached to a biaxial pivot bracket 11 through the pivotal axis 12 permitting vertical control movements of the tiller 9. The biaxial pivot bracket 11 is pivotally attached to the tiller hinge bracket 13 through the pivotal axis 14 which permits lateral control movements of the tiller 9. To maintain the operative relationship of all the parts the tiller hinge bracket 13 is affixed to the vertical surface of the stern of the hull 1.

Each of the rudders 8 has its upper end encased inside a rudder guide box 19 which is pivotally mounted to the vertical surface of the stern through rudder hinge bracket 15 (the left side bracket is not shown). It can be seen that the right rudder pivot axis 16 and the left rudder pivot axis 17 are parallel to the leading edges of the right and left rudders respectively when the rudders are in the fully lowered position as shown in FIG. 4. Both of the rudders 8 may be fully raised in the dashed line position of FIG. 1 or even partially raised and locked in any intermediate position through pivotal attachments to the rudder guide boxes 19 each of which have a rudder raising pivot axis 18 that are perpendicular to the rudder pivot axis 16 and 17 respectively. The raising mechanism for the rudders and the locking mechanism of the rudders which locks the rudders in any intermediate position are not shown inasmuch as such mechanisms are standard ordinary practice in the art. This particular arrangement permits the raising of the rudders 8 while underway without affecting the control function of the rudders. However, if the rudders are raised while the craft is underway a certain amount of efficiency is lost inasmuch as the rudders are designed to be operated in a fully lowered position.

At the high speeds which the invention of the present disclosure is designed to attain, the aerodynamic cleanliness of the entire craft becomes of great importance. In the figures it can be seen that whenever possible, the present invention has aerodynamically clean lines comparable to a high performance sail plane. However, the invention will work as previously discussed with less efficiency on virtually any type of sailing craft.

At certain times during extreme wind or possibly sea conditions the negative dihedral of the hydroplaning wing 2 eliminates the formation of aerodynamic lift on the windward side when the apparent wind strikes the hydroplaning wing with a negative angle of attack as is shown in FIG. 3 by the arrow W. However, on the leeward side the apparent wind strikes the hydroplaning wing with a positive angle of attack thereby producing aerodynamic lift tending to stabilize the craft about its longitudinal axis.

It has been found that at speeds in the range of thirty to fifty knots and in moderate sea conditions, the hull may at times momentarily become free of the water. The rudders 8 are designed to have a deeper draft than the hull and therefore the helmsman still has control of the re-entry angle of the hull and the angle of attack of the hydroplaning wing 2.

In FIG. 2 the dashed line S shows the moderate speed wetted area of the bottom of the hydroplaning wing 2. In the same figure the dashed line R shows the approximate size and shape of the wetted area when the craft is moving at a higher speed. Due to the curvature of the bottom of the hydroplaning wing 2, as seen in the elevation view of FIG. 1, and due to partial rising of the hydroplaning wing at higher speed, the aspect ratio of the wetted area is increased. When the aspect ratio increases, the hydrodynamic efficiency of the hydroplaning wing 2 increases, and consequently, the drag is reduced. Also the area scribed by the line R is smaller than the area scribed by the line S, showing that at higher speeds less surface drag producing area is in contact with the water. These two drag reducing factors combined with the aforementioned foaming action and the partial rising of the hull 1, effectively limit the drag build-up of the hydroplaning wing sailing craft as its forward speed increases.

I have found that, from a model which I built embodying the proposed invention, the follwoing facts were obtained as measured by me:

| Specification of Tested Model Boat | |
|---|---|
| Boat Length | 18 feet |
| Wing Span | 18 feet |
| Sails and Rigging G-Cat | 16 feet |
| Total Weight of Boat Fully Rigged | 400 pounds |
| Buoyancy of Wing on each side | 200 pounds |
| Effective Buoyancy of Wing each Side | 100 pounds |
| Hydroplaning Lift Generated by One Wing at 5 knots | 50 pounds |
| Hydroplaning Lift Generated by One Wing at 10 knots | 200 pounds |
| Hydroplaning Lift Generated by One Wing at 20 knots | 800 pounds |
| Hump Speed (Speed above which drag grows at rate less than velocity squared) | 10 knots |
| Loaded weight of Boat | 600 pounds |
| Measured speed in 15 knot wind | 20 knots |

From the above, it can be seen that under certain conditions, with a properly rigged and designed craft, the forward speed of the craft can be in excess of the speed of the wind.

What is claimed is:

1. A hydroplaning winged sailing craft having a hydroplaning wing structure and a sailing rig means for producing a heeling moment and forward thrust to the craft comprising a buoyant hull structure, the hydroplaning wing structure being mounted with a negative dihedral transversely to the longitudinal axis of said hull, the wing structure having a forward sweep thereto toward the bow of the hull structure with respect to the longitudinal axis of the hull, the outermost portions of the wing diverging upwardly with a positive dihedral in a gentle curve from the lateral plane which extends outwardly from the longitudinal axis of the hull, the lowest part of the wing on each side of the craft being above the water-load-line of the craft when the craft is levelled about its longitudinal axis, the wing having a positive angle of incidence to provide hydroplaning lift when the craft moves forward under thrust, means for providing positive control of the helm of the craft's direction of movement, of pitch attitude and of angle of attack of the hydroplaning wing.

2. The hydroplaning winged sailing craft as claimed in claim 1, wherein said positive angle of incidence being effective to counter the heeling moment of the sail which is imparted to the hull structure when the craft moves under thrust, the wing having sufficient buoyancy to counteract heeling moments produced by the sailing rig when the craft is at rest.

3. The hydroplaning winged sailing craft of claim 2, wherein the center of hydroplaning lift of the hydroplaning wing is laterally outward and longitudinally forward of the center of gravity of the craft, and said hydroplaning lift acts to counter both the heeling moment and the forward pitching moment of the forces transmitted to the hull by the sailing rig, whereby whenever increased wind forces act upon the sailing rig and propel the hull through the water the center of lift of the hydroplaning wing simultaneously moves laterally outward and longitudinally forward due to the gentle upwardly curve and forward sweep of the hydroplaning wing to compensate for the increased heeling moment and the increased forward pitching moment of the thrust of the sail respectively without any action required by the helmsman.

4. The hydroplaning winged sailing craft as claimed in claim 3, including means of decreasing aerodynamic lift on the windward side of the wing and means of simultaneously increasing aerodynamic lift on the leeward side of the wing whereby the craft is stabilized about its longitudinal axis.

5. The hydroplaning winged sailing craft as claimed in claim 4, wherein the wing terminates with separated distal ends, each of said distal ends having the underside of the tip portion thereof tangent to a plane having a point of tangency at the lowest point on the buoyant hull.

6. The hydroplaning winged sailing craft as claimed in claim 5, wherein said means of providing positive control of the helm comprises a tiller, rudder means, means for linking the tiller to the rudder means, said rudder means comprising a pair of rudders each having a proximal end and a distal end, each proximal end being attached to the linking means and the distal ends diverging from the linding means to form an included acute angle between the pair of rudders.

7. The hydroplaning winged sailing craft as claimed in claim 6, comprising pivotal mounts for said rudders wherein the rudders are each individually pivotally mounted to said sailing craft, to permit rotational movement of said rudders by said linking means.

8. The hydroplaning winged sailing craft as claimed in claim 7, wherein the linking means comprises control mixing means to selectively rotate the rudders about the pivotal mounting in the same direction or in opposite directions wherein the rotation of the rudders in the same direction produces directional control of the craft and the rotation of the rudders in opposite directions produces toeing of the rudders for pitch control of the craft.

9. The hydroplaning winged sailing craft as claimed in claim 8, wherein tensioning means are provided for positioning the rudders in a neutral toe in toe out position to effect a skulling motion the rudders for thrust to the craft upon the craft upon the craft being set into a rocking motion about the lateral axis of the craft.

10. A steering mechanism for a hydroplaning winged sailing craft means of providing positive control of the helm comprising a tiller, a rudder means, linking means for linking the tiller to the rudder means, said rudder means comprising a diverging pair of two-piece rudders each having a proximal end and a distal end, the proximal end of each rudder comprising a rudder guide box attached to the linking means, each rudder guide box having a longitudinal axis about which each guide box is rotationally mounted, said linking means comprising a control mixing means to selectively rotate the rudders about said longitudinal axis for each rudder so as to pivotally rotate the rudders in the same direction or in opposite directions, the distal end comprising a rudder extending from the rudder guide box, the diverging pair of rudders forming an included acute angle between the pair of rudders, the individual rudders being mounted in the respective individual guide boxes about a rudder raising pivot axis to enable the rudders to arcuately move about said rudder raising pivot axis, the rudder raising pivot axis being perpendicular to the respective longitudinal axis about which the rudder guide box is rotationally mounted, said rudders being so mounted as to move arcuately about the rudder raising pivot axis to any intermediate position from a full operative downward position to a full out-of-the-water upward position thereby permitting raising of the rudders while the craft is underway without affecting the control functions of the rudders, tensioning means for the tiller whereby the helmsman, by proper tensioning of the tensioning means, causes the rudder means to produce a continuous pitch trim moment about the lateral axis of the craft.

* * * * *